United States Patent [19]

Bergkvist

[11] Patent Number: 4,932,086

[45] Date of Patent: Jun. 12, 1990

[54] NURSING TABLE

[75] Inventor: Hakan Bergkvist, Bromma, Sweden

[73] Assignee: Baby Björn AB, Stocksund, Sweden

[21] Appl. No.: 353,607

[22] Filed: May 18, 1989

[30] Foreign Application Priority Data

May 18, 1988 [SE] Sweden ..... 8801865

[51] Int. Cl.[5] ..... A61H 33/02; A47K 3/024; A47K 3/064

[52] U.S. Cl. ..... 4/546; 4/551; 4/559; 4/572; 4/586

[58] Field of Search ..... 4/551, 548, 549, 546, 4/586, 587, 559, 572, 585, 661, 619, 643

[56] References Cited

U.S. PATENT DOCUMENTS

| | | | |
|---|---|---|---|
| 1,792,696 | 2/1931 | Masters | 4/572 |
| 2,465,909 | 3/1949 | Merrett | 4/586 |
| 2,602,167 | 7/1952 | Mulcahy | 4/551 |
| 2,614,264 | 10/1952 | Schmidt, Jr. | 4/572 |
| 2,698,948 | 1/1955 | Levitt | 4/586 X |
| 2,719,306 | 10/1955 | Leyitt | 4/551 |
| 2,902,699 | 9/1959 | Miller | 4/551 |
| 3,094,711 | 6/1963 | Kentes | 4/586 X |
| 4,150,445 | 4/1979 | Boiley | 4/546 |

FOREIGN PATENT DOCUMENTS

| | | | |
|---|---|---|---|
| 2203752 | 8/1973 | Fed. Rep. of Germany | 4/572 |
| 116949 | 8/1946 | Sweden | 4/551 |

*Primary Examiner*—Henry K. Artis

*Attorney, Agent, or Firm*—Fleit, Jacobson, Cohn, Price, Holman & Stern

[57] ABSTRACT

An infant's nursing table includes a stand which can be placed on a bath tub and which carries a table leaf arrangement. The stand has two pairs of legs which extend down on two mutually opposite sides of the table leaf arrangement and which are connected in pairs beneath the table leaf arrangement by means of two cross members. The cross members are intended to rest against two opposite bath edges and can be adjusted with respect to their lengths. The downwardly extending stand legs can be connected to respective cross members at different locations along their lengths. The legs are clamped firmly against respective cross members. Each leg is provided with a multiple of indents which are spaced along the length of the leg and which are configured to receive partially a cross member pressed laterally against said leg.

7 Claims, 3 Drawing Sheets

NURSING TABLE

The present invention relates to an infant's nursing or dressing table.

U.S. Pat. No. 2,698,948 discloses a nursing table, or dressing table, which comprises a table leaf arrangement including a hinged table leaf which functions as an infant support surface, and an infant's bath tub of flexible material arranged beneath said table leaf. The table leaf arrangement is carried by a stand which has legs depending therefrom and cross members which are connected to the lower ends of the legs. The legs are provided with foot members adapted to rest on the side edges of a conventional bath tub, and these foot members can be connected to respective legs at different locations therealong so as to adjust the level of the table leaf in relation to the height of said conventional bath tub. U.S. Pat. No. 2,465,909 discloses a somewhat similar infant's nursing table, having its cross members permanently connected to the lower ends of the legs. The cross members are intended to rest at their respective ends on the side edges of a conventional bath tub and the lengths of said cross members can be adjusted so as to adapt the cross members to bath tubs of varying widths.

The object of the present invention is to provide a novel and advantageous nursing table which is particularly suitable for use when the nursing table is to be supported on bath tubs which are of mutually different heights.

To this end, there is provided in accordance with the present invention an infant's nursing table comprising a stand capable of being placed on a bath tub, and a table leaf arrangement carried by said stand, said stand having depending on two mutually opposite sides of the table leaf arrangement pairs of legs which are attached in pairs at a distance beneath the table leaf arrangement to two cross members, each of which is intended to rest on two mutually opposite bath tub edges, wherein the depending stand legs can be connected to associated cross members at different locations along their lengths, and wherein the legs are clamped firmly against respective cross members, each leg being provided with a multiple of indents which are spaced along the length of each leg and which are configured to receive partially a cross member pressed against said leg. This arrangement will provide a nursing table with which the table leaf arrangement can always be positioned at an optimum level with respect to the work posture of the person nursing the infant and also with respect to the extremely important eye-to-eye contact between the infant and said person, irrespective of the height of the bath. Furthermore, the invention provides an optimum design from the aspect of corrosion, necessitating a minimum of bores through the various parts of the nursing table.

Further characteristic features of the invention are set forth in the depending claims.

The invention will now be described in more detail with reference to a non-restrictive exemplifying embodiment thereof illustrated in the accompanying drawings, in which.

Figure 1:
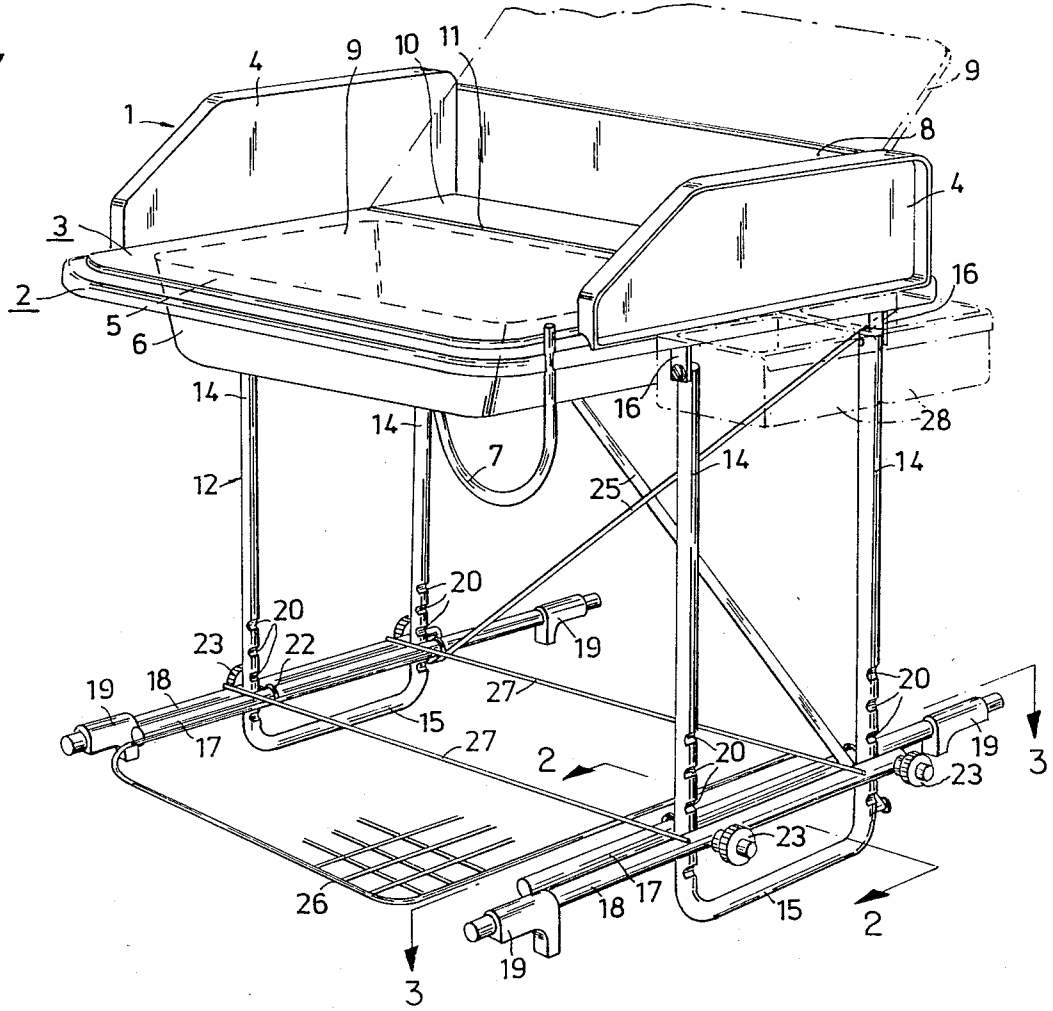
FIG. 1 is a perspective view of an inventive nursing table, or dressing table, seen obliquely from above.

The illustrated nursing or dressing table comprises a table leaf arrangement which is identified generally by the reference numeral 1 and which includes bottom and top table leaves 2 and 3, respectively. The bottom table leaf 2 is preferably made of a rigid plastics material and has side supports 4 connected to two edges thereof. The bottom leaf 2 also has provided therein an opening 5 which accommodates an infant's bath tub 6 which is made of a soft flexible material, such as an approproate plastic fabric, and which is firmly clamped around the defining edges of the opening 5. Connected to the bottom of the bath tub 6 is a drain pipe 7, the free end of which is held above the level of the bottom leaf 2 when the tub is full, for instance is inserted into a receiving slot in said leaf 2, as will best be seen from FIG. 1. The top table leaf 3 will be preferably easily detached and is shown to include a back piece 8 which can be attached to the side supports 4 in a substantially vertical position, and also a front piece 9 and an intermediate piece 10. The front piece 9 covers the larger, forwardly located expanse of the leaf 2 containing the opening 5. The front piece 9 will conveniently have a rigid core, which is covered with an upper soft upholstery so as to be able to serve, in the position shown in full lines in FIG. 1, as a support surface when changing an infant's diaper for instance. The front piece 9 is hinged to the intermediate piece 10 by hinge means 11, and can be swung to the position shown in chain lines in FIG. 1, so as to provide access to the infant's bath tub 6 and enable said tub to be used.

Figure 4:
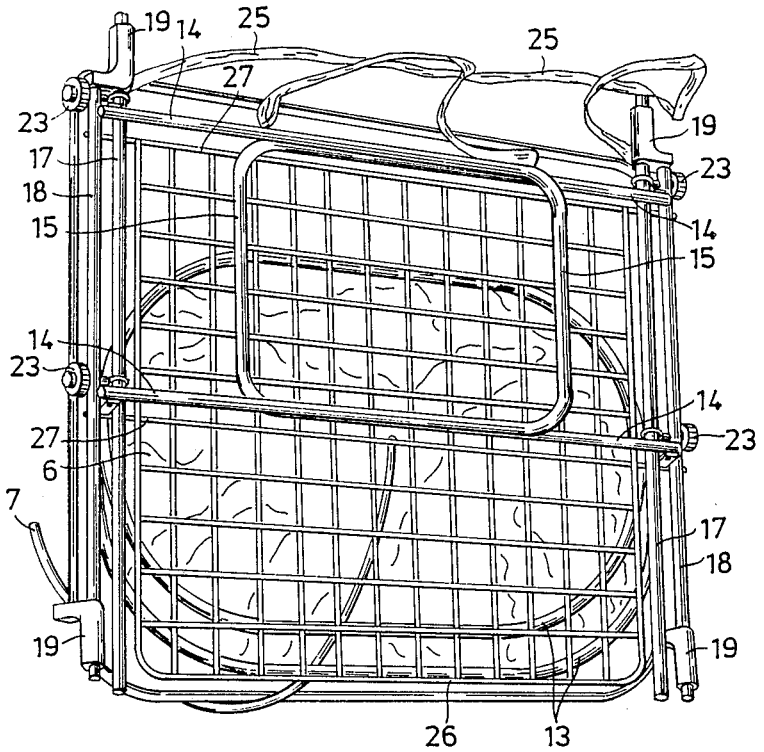
FIG. 4 is a perspective view taken from beneath of a nursing table similar to the table shown in FIG. 1, but with certain parts of the table leaf arrangement removed and the stand legs collapsed against the under side of the table leaf arrangement.

The table leaf arrangement 1 is carried by a stand, generally referenced 12, which comprises frame members 13 (FIG. 4) in abutment with the undersurface of the leaf 2 and legs 14 depending from said members. The stand 12 has on two mutually opposite sides of the table leaf arrangement 1 respective pairs of depending legs 14, the legs 14 of each pair being connected together at their bottom ends by a respective connecting piece 15. The legs 14 are connected to the frame members 13 through the intermediary of lugs 16 (FIG. 1) depending from said frame members. More specifically, the upper ends of the legs 14 are journalled on the lower ends of the lugs 16, so as to enable the legs to be swung around axes which extend parallel with and beneath the table leaf in spaced relationship therewith, such as to enable the legs 14 to be folded up beneath the bottom of the table leaf arrangement 1, as illustrated in FIG. 4.

The stand 12 also includes a pair of cross members, which in the illustrated embodiment each comprise two mutually adjacent rods 17, 18 which extend parallel with the connecting pieces 15. Each of the rods 17, 18 carries at respective opposite ends a support shoe 19 which is intended to support against the top or lip surface and the inside surface of two edges of a conventional bath tub (not shown) located adjacent the opposite ends of the cross members. The legs 14 can be connected to respective cross member 17, 18 at different locations along their lengths, so as to enable the nursing table to be mounted on a conventional bath tub, with the table leaf arrangement 1 located at a desired distance above the rim of the tub.

Because the nursing table is intended for use in a comparatively moist atmosphere, it is desirable to minimize the number of holes through the various parts of the table. Consequently, in the case of the illustrated embodiment, the connection between legs 14 and cross members 17, 18 is a clamping arrangement which enables the legs 14 to be clamped to their respective cross members 17, 18, wherewith each leg 14 is provided with indents 20 which are configured to accommodate partially a cross member pressed against the leg, therewith to prevent unintentional sliding of said leg in relation to said cross member.

Figure 2:
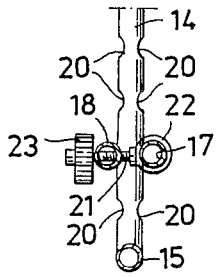
FIG. 2 is a sectional view of a cross member and is taken on the line 2—2 in FIG. 1.
Figure 3:
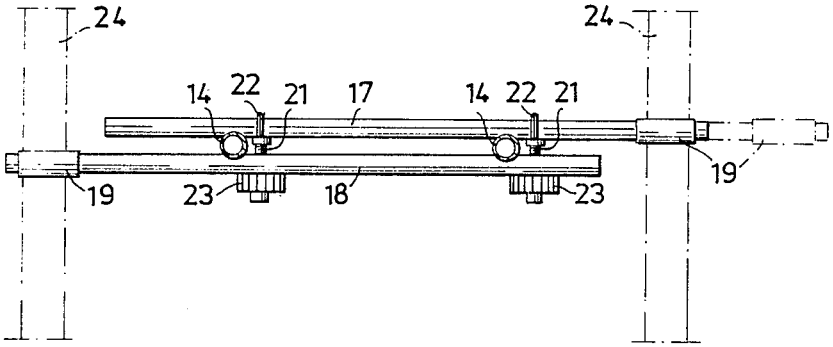
FIG. 3 is a view on the line 3—3 in FIG. 1, taken in the direction of the arrows.

As will best be seen from FIGS. 2 and 3, each cross member comprises two mutually adjacent rods 17, 18, each of which is located on a respective side of the legs 14 associated therewith. Formed on two mutually opposite sides of the legs 14 facing respective rods 17, 18 are indents 20 which are spaced along the length of respective legs 14 and adapted to conform to the peripheral shape of the rods. The rods 17 and 18 are pressed against the opposite sides of the legs 14 and fixed in position mutually and relatively to the legs 14 by means of clamping devices 21–23, each of which includes a screw threaded stem 21, an eye part 22 located at one end of the stem 21 and a nut 23 which is screwed onto the stem 21. The stem 21 extends through a transverse hole in one, 18, of the rods of a cross member 17, 18, while the other, 17, of said rods is embraced by the eye part 22. When the nut 23 is tightened, the eye part, and therewith the rod 17, is drawn against the leg 14, which is in turn pressed against the rod 18, so as to fix the rods and the leg relative to one another. The leg 14 can be raised and lowered in relation to the rods 17, 18 subsequent to slackening the nut 23, so as to adjust the vertical level of the table leaf arrangement 1, and the rod 17 can be displaced in the direction of its longitudinal axis in the eye parts 22 in relation to the rod 18, so as to adjust the distance between the shoes 19 to different bath widths, as indicated by the chain lines furthest to the right in FIG. 3. The chain lines 24 in FIG. 3 indicate two opposite edges of a bath tub.

When the nursing table is to be collapsed from the state illustrated in FIG. 1 to the state illustrated in FIG. 4, the nuts 23 are slackened and the cross members 17, 18 moved up into the immediate proximity of the under surface of the table leaf arrangement 1, between said under surface and the pivot axes of the legs 14. The legs 14 are then swung in underneath the table leaf arrangement, as illustrated in FIG. 4. In order to prevent the legs 14 from swinging unintentionally in opposite directions from the position illustrated in FIG. 1 and forming an angle greater than 90 degrees with the undersurface of the table arrangement 1, two mutually intersecting straps 25 are provided, each of which extends between an attachment on the lower end of a leg on one side of the nursing table to an upper attachment on the frame members 13 on the opposite side of said table, the lengths of respective straps 25 determining the maximum value of said angle. In order to prevent the legs 14 from swinging unintentionally in beneath the table leaf arrangement 1 from the position illustrated in FIG. 1, there is provided a perforated shelf 26 which can be displaced along the legs 14 and which functions as a spacer means for holding apart the cross members 17, 18, and therewith the legs 14, on the opposite sides of the nursing table. In the case of the illustrated embodiment, the shelf 26 rests on the cross members 17, 18 via rods 27 which project over said cross members and which are rigidly connected to the cross-member rods 18 on opposite sides of the table. The stems 21 together with parts of the rods 17, 18 and 27 also surround the legs 14, so as to prevent the shelf 26 from moving in the direction of the cross members 17, 18. When the table is collapsed to the state illustrated in FIG. 4, the shelf 26 is positioned between the undersurface of the table leaf arrangement 1 and the cross members 17, 18.

The reference 28 in FIG. 1 indicates optional dishes or like receptacles intended, for instance, for soap and other accessories and capable of being attached to the table. Although not shown, the nursing table may also be provided with hooks or like devices on which towels, flannels etc. may hang.

It will be understood from the aforegoing that the invention provides an advantageous nursing table which can be adjusted to desired heights in dependence of the level of the support surface used, so that the nurse will have good eye-to-eye contact with the infant being nursed and a comfortable working position at all times. The nursing table can be collapsed to a flat state, by pushing up the cross members 17, 18 and the shelf 26 and folding in the legs 14, such that the table will require only a small storage space. As illustrated in FIG. 4, the side pieces 4 can be detached from the table when storing the same. From the aspect of corrosion, the particular construction of the cross members 17, 18 and the indents 20 in the legs 14 which accommodate partially the cross-member rods, provides a particularly advantageous embodiment of the nursing table.

The invention is not restricted to the illustrated and described embodiment thereof, but modifications can be made within the scope of the inventive concept defined in the following claims.

I claim:

1. An infant's nursing table comprising a stand adapted to be placed on a bath tub, and a table leaf arrangement carried by said stand, said stand having depending on two mutually opposite sides of the table leaf arrangement, pairs of legs which are attached in pairs at a distance beneath the table leaf arrangement to two cross members each cross member comprises two mutually adjacent rods which can be displaced axially in relation to one another and locked in relation to one another in different axial positions of displacement, wherein the legs extend down between the rods of respective cross members and wherein the rods of each cross member can be pressed against opposite sides of the legs so as to fix the rods in position relative to one another and relative to said legs, each of said cross members adapted to rest on two mutually opposite bath tub edges, wherein the depending stand legs are connectable to said cross members at different locations along their lengths, and wherein said legs are clamped firmly against said respective cross members, each leg provided with a multiple of indents which are spaced vertically along the length of each said leg and which are configured to receive partially a cross member pressed against said leg.

2. A nursing table according to claim 1, wherein two opposite sides of the legs facing a respective one of said rods have indents spaced therealong.

3. A nursing table according to claim 1, wherein the table includes clamping devices which are intended to fix the rods of each cross member relative to one another and each of which includes an externally screw threaded stem which extends displaceably through a transverse hole in one of the rods of the cross member, the stem having provided at one end thereof an eye part which surrounds the other of the rods of said cross member at least partially, wherein the other end of said stem, remote from its eye part, is in engagement with a nut screwed onto said stem.

4. A nursing table according to claim 1, wherein the legs can be folded in against the underside of said table leaf arrangement, subsequent to displacing the cross members along said legs to a position immediately adjacent the under surface of the table leaf arrangement.

5. A nursing table according to claim 1, wherein a shelf which can be displaced along the legs is arranged between the undersurface of the table leaf arrangement and the cross members.

6. A nursing table according to claim 1, wherein a shelf which can be displaced along the legs is arranged between the undersurface of the table leaf arrangement and the cross members, said shelf being firmly attached to one of the rods of each cross member.

7. A nursing table according to claim 6, wherein the rod of each cross member firmly connected to the shelf is axially immovable in the transverse direction of the legs.

* * * * *